United States Patent [19]

DeMeyer et al.

[11] 4,406,246

[45] Sep. 27, 1983

[54] PROTECTIVE MASK

[75] Inventors: Ronald A. DeMeyer, Silvis, Ill.; Vernon T. Wilson, Bettendorf, Iowa; Nabil T. Subh, Davenport, Iowa; James E. Ballard, Eldridge, Iowa

[73] Assignee: Deere & Company, Moline, Ill.

[21] Appl. No.: 263,449

[22] Filed: May 14, 1981

[51] Int. Cl.[3] ..... B05C 11/00

[52] U.S. Cl. ..... 118/505; 118/301; 248/206 R

[58] Field of Search ..... 118/505, 301, 504; 248/206.2, 206.3, 206.4, 205.8, 205.9

[56] References Cited

U.S. PATENT DOCUMENTS 2,286,473 6/1942 Duggan ..... 118/505

2,290,472 7/1942 Hendrick ..... 118/505

2,959,152 11/1960 Byers et al. ..... 118/505

3,649,069 3/1972 Zip ..... 248/205.9

FOREIGN PATENT DOCUMENTS 2045751 3/1972 Fed. Rep. of Germany ..... 118/504

911553 11/1962 United Kingdom ..... 118/505

*Primary Examiner*—John D. Smith

*Assistant Examiner*—Bernard F. Plantz

[57] ABSTRACT

A protective mask for protecting a portion of a surface area of a generally non-porous member wherein the portion of the area to be protected is substantially smooth. The mask encloses a housing having a back face and a plurality of enclosing side walls, suction means for attaching the mask to the member, and release means.

1 Claim, 4 Drawing Figures

PROTECTIVE MASK

BACKGROUND OF THE INVENTION

The present invention relates to protective mask for a structure, and more particularly to protective masks for wall mounted windows.

For the purpose of illustration, it is customary in the manufacturing of industrial vehicles to mount the windows in the cab prior to placing the final coat of paint on the vehicle. Since customarily the vehicle receives spray painting, it is necessary to mask the vehicle windows for protection. A common means of protecting the windows is to tape cardboard to the windows prior to painting, which can be an extremely time-consuming process.

SUMMARY OF THE INVENTION

It an objective of the present invention to present a mask for protecting a portion of a panel-like structure wherein the mask can be easily attached and removed. It is a further objective to present an apparatus for masking a vehicle window prior to the spray painting of the vehicle wherein said masking is easily attached and removed.

The present invention presents an open ace template including a back wall and a plurality of side walls. To attach the template to the window, a plurality of suction cup assemblies are mounted to the template, each suction cup assembly having an easy-release mechanism. The side walls of the template are contoured to conform to the general shape and size of the protecting window. Applying the template merely requires placing the template over a window and applying a slight degree of force. Removing the template merely requires pulling on a release mechanism.

DETAILED DESCRIPTION OF THE PREFERRED EMBODIMENT

Figure 1:
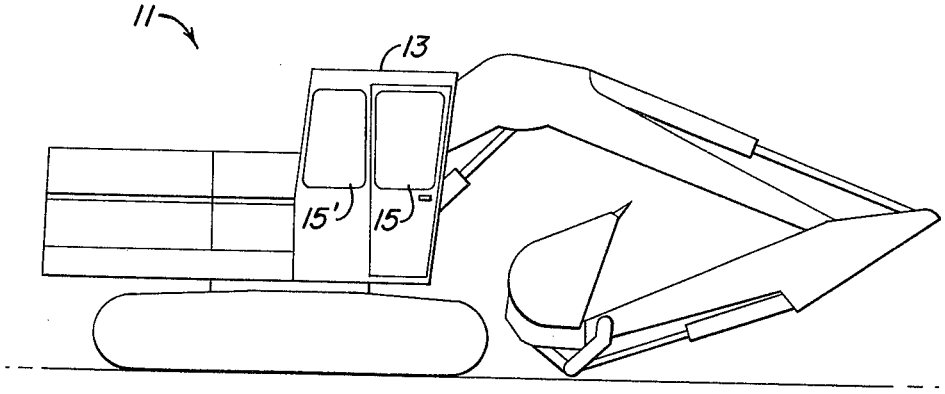
FIG. 1 is a side elevational view of an excavator.

Referring to FIG. 1, an excavator generally indicated as 11, includes a cab 13 which has a plurality of windows 15.

Figure 2:
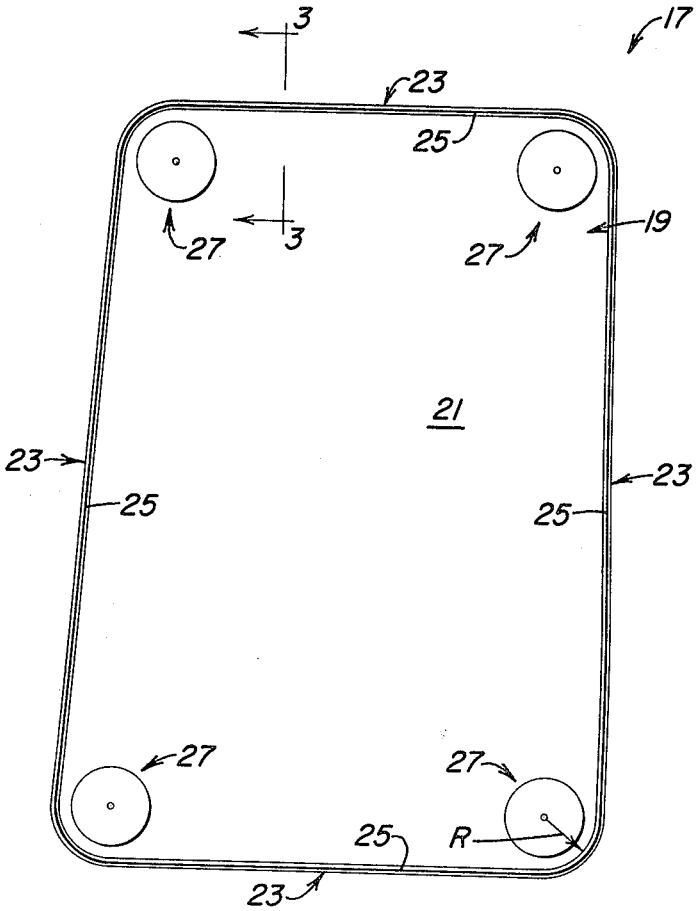
FIG. 2 is a front elevational view of the protective mask template.
Figure 3:
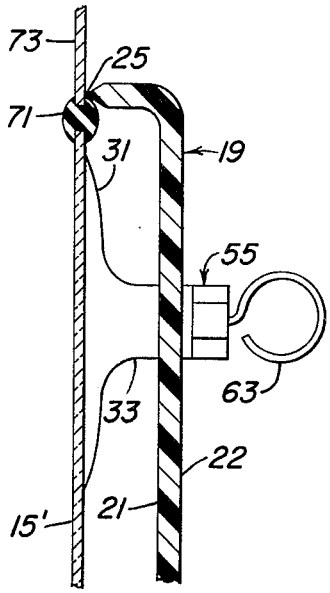
FIG. 3 is a side sectional view taken along line 3—3.

Referring to FIG. 2, to protect the window 15' during painting of the excavator cab 13, a template 17 is used and includes a back wall 19 having a forward face 21 and back face 22 (refer to FIG. 3). The template 17 has a plurality of side walls 23. Each side wall 23 has a bevelled forward leading edge 25. Placed strategically on the template's back wall is a plurality of suction cup assemblies 27. In the form of the template shown in FIG. 2, the corners are curved creating a strategic location for the placement of the suction cup assemblies 27 central to the arc radius R of the curve. The template 17 as shown in FIG. 2 has side wall 23 contoured to opposing cab window 15'.

Figure 4:
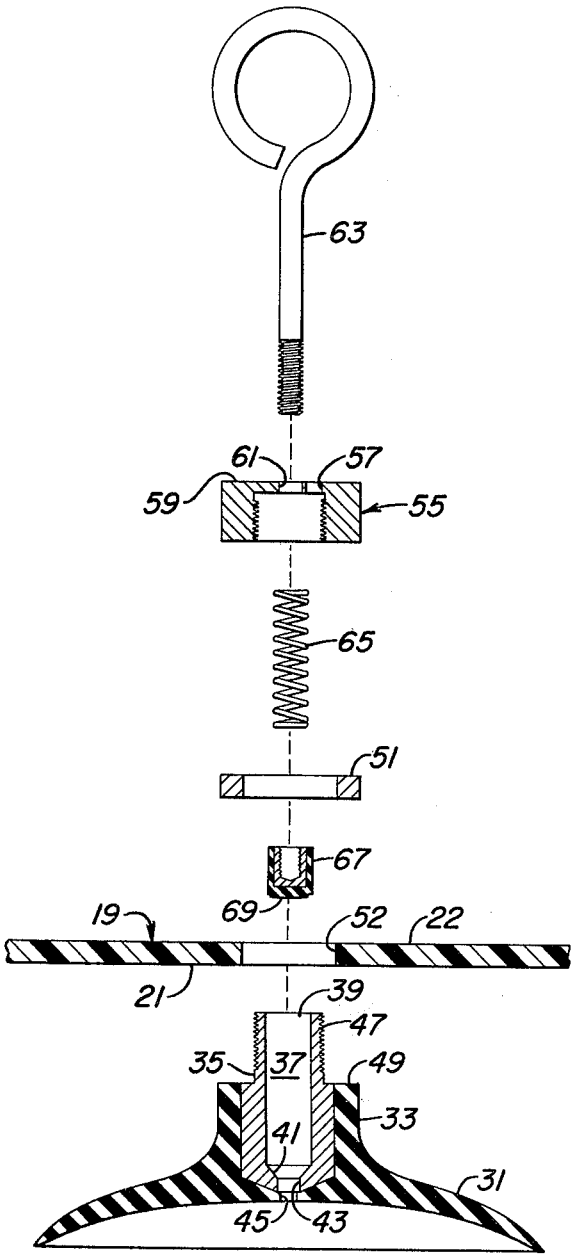
FIG. 4 is an exploded view of the suction cup release mechanism.

Referring to FIG. 3, and more particularly to FIG. 4, each suction cup assembly 27 includes a glazier suction cup 31 having a formed base 33. A generally cylindrical member 35 is mounted within the base 33 by any conventional means such as fusing. The cylindrical member 35 defines an enclosed generally cylindrical chamber 37. The chamber 37 is open at one end 39 and has an end wall 41 at the other end. A hole 43 is aligned to a hole 45 in cup 31 is contained in the end wall 41. A portion of the cylindrical member 35 extends beyond the base 33 of the glazier suction cup 31 and is threaded along its outer surface portion 47. The portion 47 extends through a hole 52 in the back face 19 of the template 17 such that a rim 49 formed by base 33 abuts the forward face 21 of the template 17. A washer 53 is then placed around portion 47 followed by a cap screw 55 to secure the suction cup assembly 27 to the back wall 19.

Cap screw 55 has a first hole 57 in head 59 to allow the free flow of air. The cap screw also has a second hole 61, in head 59. A rod-like member 63 extends into the second hole 61 journeying further into the chamber 37. A spring 65 is placed around a portion of the member 63 within the chamber 37 such that one end of the spring abuts the top of the cap screw 55. The other end of the spring 65 is restrained by a stop 67 fixably mounted to the end of the rod-like member 63 within the chamber 37. The stop 67 has a tip 69 shaped to conform to the opening 43 in the end wall 41.

Referring to FIG. 3, it is observed that the cab window 15' is in a molding 71 mounted to the cab wall 73. The template 17 is placed over the window such that the leading edge 25 of side walls 23 follow the outline of the molding 71 just beyond the window 15'. By lightly pressing the template against the window, air is allowed to escape from underneath the suction cup through the passage 45, 43 and hole 57 in cap 55, allowing the cup 31 to deform. When the pressure is removed, the air stop member 67 is biased by spring 65 to block openings 43 and 45 such that the template 19 is secured to the window. To release the template, one merely pulls on member 63.

The foregoing is a description of the preferred embodiment and should not be taken in any way as limiting the scope of the invention as defined by the following claims.

I claim:

1. An apparatus for protecting a cab window of vehicle during painting of said vehicle comprised of:

(a) a housing having a back wall and enclosing side walls, said side walls having a beveled leading edge contour to conform to the surface contour of said cab window molding such that said housing can be placed around and enclose said windows and molding, said leading edge of said sidewalls to be in close adjacent alignment with said molding;

(b) a plurality of second members, each member defining a generally cylindrically shaped interior chamber open at a first end and having an end wall at a second end, said end wall having a hole therein, said second member being threaded on its outer surface at said first end;

(c) a glazier suction cup having a base form of a convexed side of said suction cup, said base encasing a portion of said second member including said end wall, said suction cup having a hole aligned to said hole in said second member, said remaining portions of said second member extending through said housing, such that said base abuts the forward face of said back wall, said cup being exposed forward of said housing;

(d) a cap screw threadably mounted to said second member enclosing said chamber opening, said cap screw having a first and second hole therein, said cap screw mounted to said second member such that a portion of said back wall of said housing is sandwiched between said base of said suction cup and said cap screw;

(e) means for selective blocking to form an air-tight seal and unblocking said hole in said end wall of said second member including; an elongated member extending through a second hole in said cap screw into said chamber, a spring placed around a portion of said elongated member within said chamber biased at one end by said top of said cap screw and at the other end by an elastomer stop member fixably mounted to the chamber enclosed end of such elongated member, said stop member shaped to sealably close said hole in said end wall of said second member.

* * * * *